US007337771B2

(12) United States Patent
Bornitz et al.

(10) Patent No.: US 7,337,771 B2
(45) Date of Patent: Mar. 4, 2008

(54) METHOD AND APPARATUS FOR THE CYLINDER-SPECIFIC DETERMINATION AND CONTROL OF A FUEL INJECTION QUANTITY

(75) Inventors: Joachim Bornitz, Waiblingen (DE); Nicholas Fekete, Stuttgart (DE); Lorenzo Matassini, Stuttgart (DE); Ruediger Pfaff, Stuttgart (DE)

(73) Assignee: Daimler Chrysler AG, Stuttgart (DE)

( * ) Notice: Subject to any disclaimer, the term of this patent is extended or adjusted under 35 U.S.C. 154(b) by 0 days.

(21) Appl. No.: 11/452,133

(22) Filed: Jun. 13, 2006

(65) Prior Publication Data

US 2006/0254568 A1 Nov. 16, 2006

Related U.S. Application Data

(63) Continuation-in-part of application No. PCT/EP2004/013695, filed on Dec. 2, 2004.

(30) Foreign Application Priority Data

Dec. 12, 2003 (DE) ..... 103 58 108

(51) Int. Cl.
*F02D 41/30* (2006.01)
*F02D 41/00* (2006.01)

(52) U.S. Cl. ..... 123/673; 123/676

(58) Field of Classification Search ..... 123/673, 123/676, 466, 478; 73/115
See application file for complete search history.

(56) References Cited

U.S. PATENT DOCUMENTS

| | | | | |
|---|---|---|---|---|
| 4,683,857 | A * | 8/1987 | Yasuoka | 123/676 |
| 5,586,524 | A * | 12/1996 | Nonaka et al. | 123/73 A |
| 5,622,158 | A * | 4/1997 | Katoh et al. | 123/676 |
| 5,713,339 | A * | 2/1998 | Kishida et al. | 123/676 |
| 6,209,520 | B1 * | 4/2001 | Kolmanovsky et al. | 123/435 |
| 2002/0096157 | A1 | 7/2002 | Damitz et al. | |

FOREIGN PATENT DOCUMENTS

| | | |
|---|---|---|
| EP | 1 061 246 | 12/2000 |

* cited by examiner

*Primary Examiner*—Mahmoud Gimie
(74) *Attorney, Agent, or Firm*—Klaus J. Bach

(57) ABSTRACT

In a method and apparatus for the cylinder-specific determination and control of a fuel injection quantity for a multi-cylinder internal combustion engine, the exhaust gas pressures of the cylinders of the internal combustion engine is recorded on a time-resolved, i.e. crankshaft angle-resolved, basis, and an exhaust gas pressure is calculated therefrom individually for each cylinder and used to determine the fuel quantity injected into the corresponding cylinder. In a comparison with a desired value the cylinder-specific actual fuel injection quantity error is then determined and used to set a corrected quantity of fuel to be injected into the corresponding cylinder.

7 Claims, 2 Drawing Sheets

METHOD AND APPARATUS FOR THE CYLINDER-SPECIFIC DETERMINATION AND CONTROL OF A FUEL INJECTION QUANTITY

This is a Continuation-In-Part application of International Application PCT/EP2004/013695 filed Dec. 2, 2004 and claiming the priority of German application 103 58 408.1 filed Dec. 12, 2003

BACKGROUND OF THE INVENTION

The invention relates to a method for the cylinder-specific determination of the injected fuel quantity in a multicylinder internal combustion engine and to an apparatus for controlling the cylinder-specific fuel injection quantity. In the present context, the term "cylinder" is used to indicate any types of combustion chamber of internal combustion engines.

In multi-cylinder internal combustion engines with cylinder-specific fuel injection, it is necessary to set a defined fuel/air mix for each cylinder, generally as far as possible the same mix, i.e. with the same air/fuel ratio or lambda value, for all the cylinders. In this context, however, different mixes may be formed in the individual cylinders even if the formation of identical mixes is actually intended, for example on account of manufacturing tolerances and different ageing properties of injection nozzles assigned to the individual cylinders and on account of differences in the air mass which is drawn in for the respective cylinder. Corresponding adaptive control of the injected fuel quantity is expedient in order to compensate for these effects.

To achieve mixes which are as uniform as possible in the individual cylinders of an internal combustion engine, it is known for the combustion air ratio, i.e. the lambda value, in the exhaust gas of the internal combustion engine to be measured on a time-resolved basis by means of a lambda sensor, and for the quantity of fuel injected into the respective cylinder to be controlled on the basis of the measurement signal from this lambda sensor. On account of the slow response of lambda sensors, with typical reaction times of not significantly below 100 ms, with this procedure it is relatively difficult to use the measured lambda values to ascertain the cylinder-specific deviations in the injected fuel quantity and to assign these deviations to the individual cylinders. Moreover, it is almost impossible to correctly identify the cause of control deviations, i.e. whether they are caused, for example, by different injected fuel quantities or different intake air masses.

It is the object of the present invention to provide a method for the cylinder-specific determination of a fuel injection quantity as well as an associated method and apparatus for the cylinder-specific control of the fuel injection quantity, which, with relatively little outlay, allow comparatively accurate cylinder-specific determination of the fuel injection quantity and correspondingly accurate control of the fuel quantity being injected into each cylinder.

SUMMARY OF THE INVENTION

In a method and apparatus for the cylinder-specific determination and control of a fuel injection quantity for a multi-cylinder internal combustion engine, the exhaust gas pressures of the cylinders of the internal combustion engine is recorded on a time-resolved, i.e. crankshaft angle-resolved, basis, and an exhaust gas pressure is calculated therefrom individually for each cylinder and used to determine the fuel quantity injected into the corresponding cylinder. In a comparison with a desired value the cylinder-specific actual fuel injection quantity error is then determined and used to set a corrected quantity of fuel to be injected into the corresponding cylinder.

In the method according to the invention for the cylinder-specific determination of the fuel injection quantity, an exhaust gas pressure of the internal combustion engine is recorded on a time-resolved basis, and an exhaust gas pressure discharge is determined individually for each cylinder on the basis of this information and used to determine the fuel quantity injected into the respective cylinder. In the present context, the term "on a time-resolved basis" is used in the sense of the associated physical variable, such as the exhaust gas pressure, being resolved over the course of a working cycle of the internal combustion engine. In the case of internal combustion engines with a crankshaft, this corresponds, for example, to a resolution which is synchronous with the crankshaft angle, i.e. the term "crankshaft angle-resolved basis".

This method makes use of the fact that standard exhaust gas pressure sensors have reaction times of typically less than 5 ms, which are in particular significantly shorter than the reaction times of standard lambda sensors. This allows each exhaust gas pressure discharge pulse to be recognized and assigned to the respective cylinder without problems. Furthermore, this method makes use of the discovery that the strength of the exhaust gas pressure discharge is a good measure of the injected fuel quantity.

The method according to the invention and the apparatus according to the invention for controlling the cylinder-specific injected fuel quantity make use of the method according to the invention for cylinder-specific determination of the fuel injection quantity by determining, in this way, the fuel quantity which was actually injected on a cylinder-specific basis and using this information as a feedback variable for the cylinder-specific injection quantity (closed-loop) control.

In an advantageous refinement of the invention, the control of the cylinder-specific injected fuel quantity additionally involves the combustion air ratio recorded in the exhaust gas of the internal combustion engine. The measured combustion air ratio values can be used, for example, as an evaluation criterion for the efficiency of the control.

Below the invention will be described in greater detail on the basis of the accompanying drawings:

DESCRIPTION OF A PARTICULAR EMBODIMENT

Figure 1:
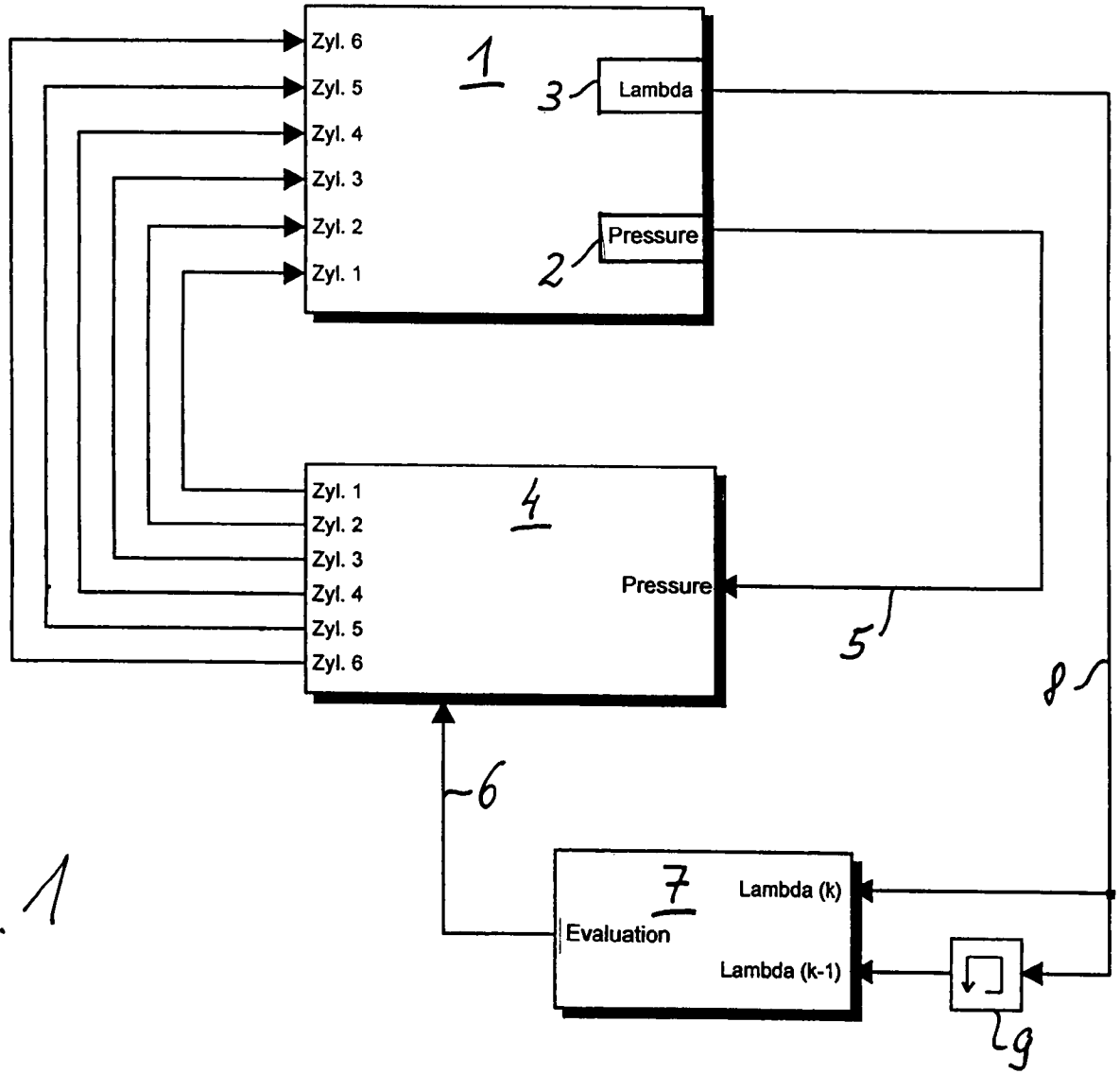
FIG. 1 shows a schematic block diagram of an apparatus for controlling the cylinder-specific injected fuel quantity for a multicylinder internal combustion engine.

FIG. 1 illustrates the invention based on the example of an internal combustion engine 1 with six cylinders, which is of conventional design and, together with its associated exhaust section, is only schematically reproduced as a functional block. An exhaust gas pressure sensor 2 and a lambda sensor 3, each of standard design, are arranged in parallel in a part of the exhaust section in which the exhaust gas branches off all six cylinders are combined. The internal combustion engine 1 may, for example, be a diesel engine with direct fuel injection for a motor vehicle.

An injection controller 4 controls the injection of fuel and therefore the air/fuel mix formation for each cylinder individually, in the course of which, in addition to other relevant injection parameters, it in particular controls the fuel injection quantity for each cylinder individually. For this purpose, the injection controller 4 receives, as input information, an exhaust gas pressure signal 5 from the exhaust gas pressure sensor 2 and a lambda value evaluation signal 6 from an evaluation unit 7, and controls fuel injection nozzles assigned to the individual cylinders accordingly.

The exhaust gas pressure sensor 2 is used to record the pressure of the exhaust gas discharged from the internal combustion engine 1 on a time-resolved basis. The upper diagram in FIG. 2 shows a typical time profile of the exhaust gas pressure measured by the exhaust gas pressure sensor 2 over one working cycle of the internal combustion engine 1, i.e. over a crankshaft angle of 720°, with the time profile plotted on the abscissa in degrees crankshaft angle (CA).

The lambda sensor 3 records the combustion air ratio of the internal combustion engine exhaust gas on a time-resolved basis. The lower diagram in FIG. 2 shows a typical profile of the exhaust gas lambda value measured by the lambda sensor 3 synchronously in terms of time, i.e. synchronously in terms of crankshaft angle, with the measured exhaust gas pressure profile of the upper diagram for the same working cycle. The measurement example shown in FIG. 2 relates to an arrangement in which the internal combustion engine 1 is provided with an exhaust gas turbocharger and the exhaust gas pressure sensor 2 and the exhaust gas lambda sensor 3 are located in the exhaust section upstream of an exhaust gas turbine of the exhaust gas turbocharger.

As can be seen from FIG. 1, an exhaust gas lambda signal 8 output by the lambda sensor 3 is fed to the evaluation unit 7, specifically without delay as the exhaust gas lambda value of an instantaneous evaluation interval k at a first input of the evaluation unit 7 and in parallel as a delayed exhaust gas lambda value of a previous evaluation interval k−1 at a second input of the evaluation unit 7, with in each case one working cycle preferably being selected as the evaluation interval. To generate the delayed exhaust gas lambda signal, a corresponding delay unit 9 is connected up-stream of the second input of the evaluation unit 7.

Figure 2:
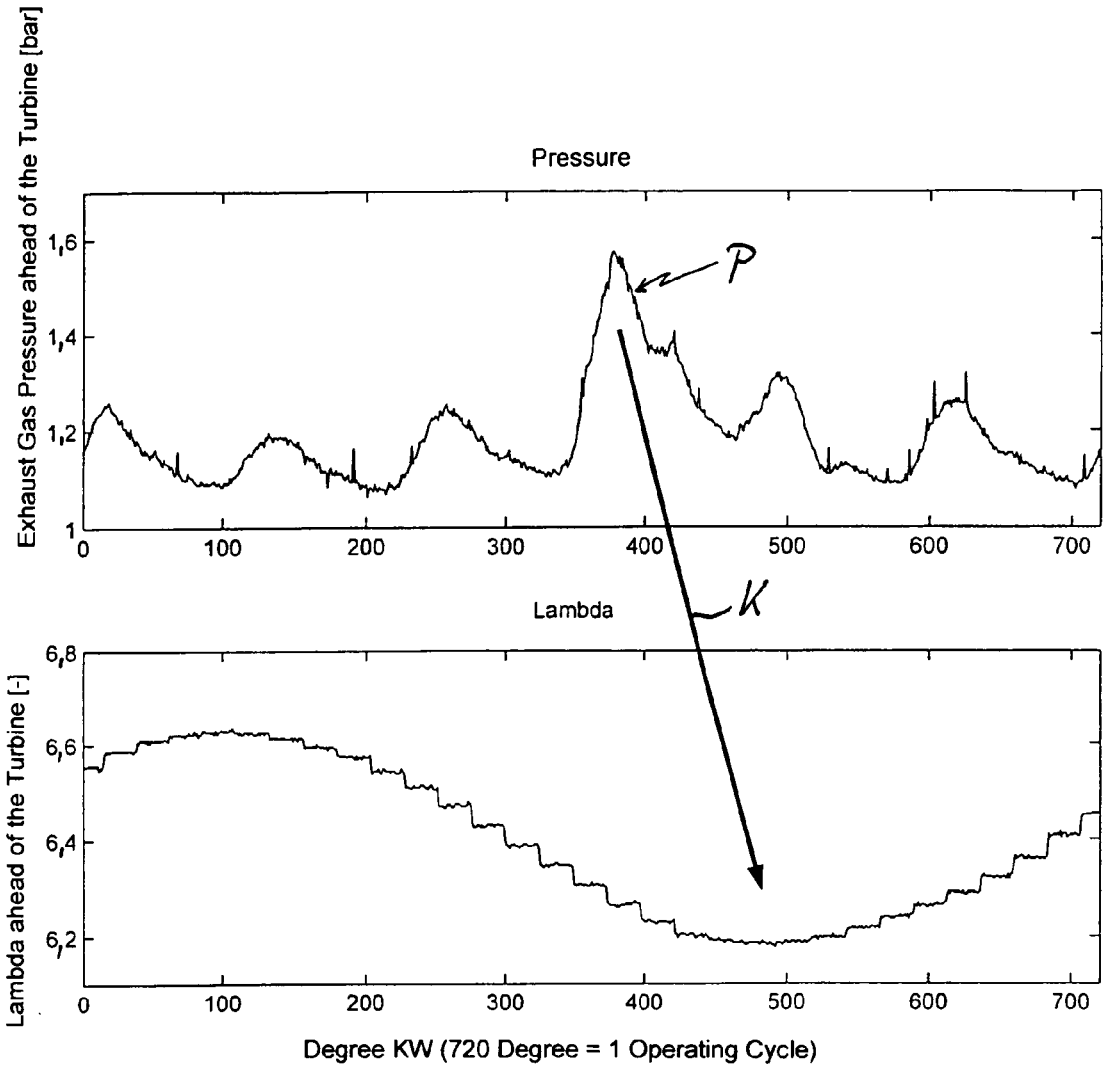
FIG. 2 shows a diagram illustrating a cylinder-specific determination of the fuel injection quantity by time-resolved recording of exhaust gas pressure and exhaust gas lambda value and for controlling the injection quantity as a function of this information using the apparatus shown in FIG. 1.

As can be seen from the exhaust gas pressure diagram of FIG. 2, the exhaust gas pressure signal from the exhaust gas pressure sensor 2 measured over one working cycle has a peak value range P. On account of the very short reaction time of the exhaust gas pressure sensor 2 of typically less than 5 ms, which is in particular very short compared to the duration of a working cycle, the peak P can be clearly and distinctly recognized in the time profile of the measured exhaust gas pressure signal and can be unambiguously assigned to a respective combustion process in a particular cylinder. By comparison, on account of the significantly longer response time of the lambda sensor 3 of approx. 100 ms, the measured exhaust gas lambda value has a more uniform profile with a minimum range which is correlated with the combustion process associated with the exhaust gas pressure peak P but appears delayed by the longer reaction time compared to the exhaust gas pressure peak P. The correlation is indicated by a bold arrow K in FIG. 2.

It is therefore clearly evident from FIG. 2 that the exhaust gas pressure peak P which is attributable to an exhaust gas pressure discharge from a respective cylinder is eminently suitable for cylinder-specific assignment. Since it can at the same time be seen that the magnitude of the exhaust gas pressure peak P is approximately proportional to the fuel quantity injected for the associated combustion process, the exhaust gas pressure signal 5 from the exhaust gas pressure sensor 2 forms a good and useful input signal for the fuel injection controller 4, from which the latter determines the fuel quantity which was actually injected into the respective cylinder.

The injection controller 4 then forms the difference between the injection quantity actual value determined on the basis of the exhaust gas pressure sensor signal 5 and a desired injection quantity value which is predetermined for the corresponding cylinder, on a cylinder-specific basis, as the control deviation, in order to set the injection quantity for each cylinder as a function of this deviation. In particular, the fuel injection control implemented in the injection controller 4 may include the measure of compensating for cylinder-specific fuel quantity deviations. At a given working point of the internal combustion engine 1, it is in this way possible to effectively inject identical quantities of fuel into the various cylinders, even if this requires different settings of the individual injection nozzles, for example on account of manufacturing tolerances and different ageing characteristics of the individual injection nozzles and any cylinder-specific differences in the intake air mass.

In addition, the fuel injection controller 4 makes use of the exhaust gas lambda value evaluation signal 6 for the fuel injection control, by using this signal as a criterion for evaluating the efficiency of the control. The intention is specifically to achieve a flat exhaust gas lambda value signal which as far as possible has a constant time profile. For this purpose, the evaluation unit 7 compares the currently measured exhaust gas lambda value with the previously measured exhaust gas lambda value which has been suitably delayed, preferably by one working cycle, and evaluates the result of the comparison with a view to moving the values closer together. This means that the injection controller 4 sets the injection parameters on the one hand as a function of the exhaust gas pressure sensor signal 5 in order to achieve defined, preferably identical injection quantities for the individual cylinders, and on the other hand as a function of the evaluation signal 6 in order to achieve a time profile for the exhaust gas lambda value which is as uniform as possible.

The exemplary embodiment as explained above makes it clear, that, by using the time-resolved measurement signal of an exhaust gas pressure sensor, a reliable cylinder-specific determination of the injected fuel quantity is obtained and the cylinder-specific injected fuel quantity can be accurately controlled based on this information, preferably additionally taking account of the time-resolved measurement signal from an exhaust gas lambda sensor.

The invention is suitable for use in diesel engines with direct fuel injection, as has already been mentioned, but also for any other desired multicylinder internal combustion engines with fuel injection to the individual cylinders. By the controlled setting of a defined air/fuel mix in each cylinder, it is possible to achieve good cylinder matching, which benefits the quality of the exhaust gas discharged from the internal combustion engine and also increases engine operating efficiency and running smoothness. The invention is relatively inexpensive to deploy, since the system components required, such as exhaust gas pressure sensor, exhaust gas lambda sensor and injection controller, are known per se and are often already installed in internal combustion engines, so that it is merely necessary to implement the corresponding method steps or control algorithms. The invention can be used to monitor the interaction between smoothness control or fuel balancing control (FBC) and lambda control and to optimize this relationship as a function of the associated operating point.

The use of the invention and in particular of the control according to the invention of the cylinder-specific injected fuel quantity allows ageing, wear and soiling effects, and therefore the deterioration over the operating time of an internal combustion engine, to be accommodated by virtue of the fact that the control is able to adaptively compensate for such effects.

What is claimed is:

1. A method for the cylinder-specific determination of an injected fuel quantity in a multicylinder internal combustion engine (1), comprising the steps of:

measuring an exhaust gas pressure in an exhaust system of an internal combustion engine, recording the exhaust gas pressure of the internal combustion engine (1) on a time-resolved basis, determining an exhaust gas discharge pressure (P) individually for each cylinder on the basis of this information, and using the exhaust gas discharge pressure (P) to determine the fuel quantity that was injected into the associated combustion process of the corresponding cylinder, and setting the injection quantity for each cylinder as a function of the fuel quantity that was injected into each cylinder.

2. A method for controlling the cylinder-specific injected fuel quantity in a multicylinder internal combustion engine (1), comprising the steps of measuring an exhaust gas pressure in an exhaust system of an internal combustion engine, recording the exhaust gas pressure of the internal combustion engine (1) on a time-resolved basis, determining an exhaust gas pressure discharge (P) individually for each cylinder on the basis of this information, determining from the exhaust gas discharge pressure the actual quantity of fuel injected into the corresponding cylinder, and setting the quantity of fuel to be injected into the corresponding cylinder as a function of the actual fuel injection quantity value determined in this way.

3. The method as claimed in claim 2, wherein a combustion air ratio in the exhaust gas of the internal combustion engine (1) is recorded on a time-resolved basis, and the quantity of fuel that is to be injected into the corresponding cylinder is additionally set as a function of the combustion air ratio of the exhaust gas recorded in this way.

4. The method as claimed in claim 3, wherein the quantity of fuel that is to be injected into the corresponding cylinder is set as a function of a currently recorded combustion air ratio value and a previously recorded, delayed, combustion air ratio value of the exhaust gas.

5. An apparatus for controlling the cylinder-specific fuel quantity injected into a multicylinder internal combustion engine, comprising an injection controller (4), an exhaust gas pressure sensor (2) arranged in an exhaust system of the internal combustion engine for the time-resolved recording of an exhaust gas pressure of the internal combustion engine (1), the injection controller (4) determining an exhaust gas discharge pressure individually for each cylinder on the basis of this information and using the exhaust gas discharge pressure to determine the quantity of fuel injected in the associated combustion process of the corresponding cylinder and setting the quantity of fuel that is to be injected into the corresponding cylinder as a function of the actual fuel quantity determined in this way.

6. The apparatus as claimed in claim 5, including an exhaust gas lambda sensor (3) for the time-resolved recording of a combustion air ratio in the exhaust gas from the internal combustion engine, the injection controller (4) additionally setting the quantity of fuel that is to be injected into the respective cylinder as a function of the combustion air ratio of the exhaust gas recorded in this way.

7. The apparatus as claimed in claim 6, including an evaluation unit (7) for evaluating the time profile of the combustion air ratio recorded by the exhaust gas lambda sensor on the basis of a currently measured combustion air ratio value and a previously measured, delayed, combustion air ratio value, the injection controller additionally setting the injection process for the respective cylinder as a function of an evaluation signal (6) provided by the evaluation unit.

* * * * *